US011793295B2

(12) United States Patent
Kobashi

(10) Patent No.: US 11,793,295 B2
(45) Date of Patent: Oct. 24, 2023

(54) FEEDING CONTAINER

(71) Applicant: SHISEIDO COMPANY, LTD., Tokyo (JP)

(72) Inventor: Yoshihiko Kobashi, Tokyo (JP)

(73) Assignee: SHISEIDO COMPANY, LTD., Tokyo (JP)

( * ) Notice: Subject to any disclaimer, the term of this patent is extended or adjusted under 35 U.S.C. 154(b) by 160 days.

(21) Appl. No.: 17/421,258

(22) PCT Filed: Jan. 17, 2020

(86) PCT No.: PCT/JP2020/001410
§ 371 (c)(1),
(2) Date: Jul. 7, 2021

(87) PCT Pub. No.: WO2020/153241
PCT Pub. Date: Jul. 30, 2020

(65) Prior Publication Data

US 2022/0117375 A1 Apr. 21, 2022

(30) Foreign Application Priority Data

Jan. 23, 2019 (JP) ..... 2019-008908

(51) Int. Cl.
*A45D 40/06* (2006.01)
*A45D 40/00* (2006.01)

(52) U.S. Cl.
CPC ..... *A45D 40/06* (2013.01); *A45D 2040/0025* (2013.01); *A45D 2200/05* (2013.01)

(58) Field of Classification Search
CPC ..... A45D 40/06; A45D 40/065; A45D 40/10; A45D 40/12; A45D 2040/105
See application file for complete search history.

(56) References Cited

U.S. PATENT DOCUMENTS 5,979,468 A * 11/1999 Blake, III ..... A45D 40/065 401/59
10,492,586 B2 * 12/2019 Paquet ..... A45D 40/12
2007/0025802 A1 2/2007 Dieudonat et al.
(Continued)

FOREIGN PATENT DOCUMENTS

CN 101095565 A 1/2008
EP 1647200 A2 4/2006
(Continued)

OTHER PUBLICATIONS

International Search Report (ISR) dated Mar. 31, 2020 filed in PCT/JP2020/001410.

*Primary Examiner* — Jennifer C Chiang
(74) *Attorney, Agent, or Firm* — Rankin, Hill & Clark LLP

(57) ABSTRACT

A feeding container includes: an inner cylinder with a through groove extending in an axial direction disposed inside an outer cylinder having a spiral groove on an inner wall surface thereof, an inner plate having a protrusion on a side surface thereof disposed inside the inner cylinder, and the protrusion of the inner plate passing through the through groove of the inner cylinder to come into engagement with the spiral groove of the outer cylinder, whereby the inner plate moves vertically in response to either a vertical movement of the outer cylinder in the axial direction or a rotary movement of the outer cylinder around an axis.

3 Claims, 6 Drawing Sheets

(56) References Cited

U.S. PATENT DOCUMENTS

| | | | | |
|---|---|---|---|---|
| 2008/0041747 | A1 | 2/2008 | Mihara et al. | |
| 2020/0154852 | A1* | 5/2020 | Lee | A45D 40/06 |

FOREIGN PATENT DOCUMENTS

| | | | |
|---|---|---|---|
| EP | 1867249 | A1 | 12/2007 |
| FR | 2876555 | A1 | 4/2006 |
| JP | 56-60507 | A | 5/1981 |
| JP | 2002-34650 | A | 2/2002 |
| JP | 2004-24716 | A | 1/2004 |
| JP | 2007-330326 | A | 12/2007 |

* cited by examiner (a) (b)

(a) (b)

(a)

(b)

FEEDING CONTAINER

TECHNICAL FIELD

The present invention relates to a feeding container for feeding a stick-shaped cosmetic product such as a lipstick.

BACKGROUND ART

There have conventionally been known a mechanism of a feeding container for feeding a stick-shaped cosmetic product such as a lipstick, which includes an outer cylinder and an inner cylinder rotating relatively, wherein when the inner cylinder is rotated with one hand while holding the outer cylinder with fingertips of the other hand, a carrier with a stick-shaped lipstick attached thereto rises or falls to feed out or store the stick-shaped cosmetic product (PTL 1), and a mechanism in which a sleeve storing a stick-shaped cosmetic product is caused o rise or fall by sliding a vertically movable operation button provided on a side surface of a feeding container, to feed out or store the stick-shaped cosmetic product (PTL 2).

Both of these feeding containers are designed such that, after a makeup application, the rotation of the inner cylinder and the sliding of the operation button cause the stick-shaped cosmetic product to retreat to an original position thereof, to be stored back into the container. Therefore, as is done previously, when applying makeup, the cosmetic product is fed out of the container, the length of the cosmetic product is adjusted, then the cosmetic product is applied, and, after the makeup application, the cosmetic product is stored back into the container.

When applying the lipstick to lips, the lipstick is fed out of the container by a length that enables easy application. Thus, the amount of lipstick used in one application is small, and the length of the lipstick fed out at the time of a makeup application does not change much each time. Therefore, the series of steps of feeding the cosmetic product, adjusting the length thereof, and storing the cosmetic product back into the container, which is required each time in the feeding containers of the prior art, may become troublesome, and rotating the inner cylinder is bothersome especially for elderly people and disabled people. In addition, repeating these steps may accidentally result in dropping of the container and damaging or breaking the lipstick.

Accordingly, a development of a feeding container is required, the feeding container being configured to be operated with a single touch when starting to apply makeup, to feed a cosmetic product by the same length as the length of the cosmetic product fed in a previous makeup application and to easily store the cosmetic product back into the container after a makeup application, as well as to finely adjust the length of the fed cosmetic product when necessary.

CITATION LIST

Patent Literature

[PTL 1] Japanese Patent Application Publication No. 2007-330326

[PTL 2] Japanese Patent Application Publication No. 2004-024716

SUMMARY OF INVENTION

Technical Problem

An object of the present invention is to provide a feeding container configured to be operated with a single touch when starting to apply makeup, to feed a cosmetic product by the same length as the length of the cosmetic product fed in a previous makeup application and to easily store the cosmetic product back into the container after a makeup application, the feeding container being also able to perform fine adjustment of the length of the fed cosmetic product when necessary.

Solution to Problem

As a result of studies by the inventors of the present invention in order to achieve the foregoing object, the inventors have completed the present invention in which an outer cylinder having a spiral groove on an inner wall surface, an inner cylinder having a through groove extending in an axial direction, and an inner plate having a protrusion on a side surface are combined, so that, with a single touch, a cosmetic product can be fed out or stored, and the length of the cosmetic product fed out can be finely adjusted when necessary.

Specifically, the present invention is a feeding container in which the inner cylinder provided with the through groove extending in the axial direction is disposed inside the outer cylinder having the spiral groove on the inner wall surface thereof, the inner plate having the protrusion on the side surface thereof is disposed inside the inner cylinder, and the protrusion of the inner plate passes through the through groove of the inner cylinder to come into engagement with the spiral groove of the outer cylinder, whereby the inner plate moves vertically in response to either a vertical movement of the outer cylinder in the axial direction or a rotary movement of the outer cylinder around an axis.

The present invention is also a feeding container provided with a control mechanism portion that is connected to the outer cylinder and regulates a range of the vertical movement of the outer cylinder in the axial direction.

The present invention is also a feeding container in which the control mechanism portion includes a lock mechanism for suppressing the vertical movement of the outer cylinder.

Advantageous Effects of Invention

The feeding container according to the present invention can be operated with a single touch when starting to apply makeup, to feed a cosmetic product by the same length as the length of the cosmetic product fed in a previous makeup application and to easily store the cosmetic product back into the container after a makeup application, and the feeding container is also capable of fine adjustment of the length of the fed cosmetic product when necessary.

DESCRIPTION OF EMBODIMENTS

A feeding container of the present invention is now described hereinafter in detail. However, the present invention is not limited to the embodiments illustrated as modes for carrying out the present invention. Additionally, in the present invention, connecting or attaching components is not limited to directly connecting the components but include indirectly connecting the components via other members. Thus, unless otherwise noted, all components apply as long as said components can substantially constantly maintain the relative positional relationship between two members at a position where the two members are attached.

Figure 1:
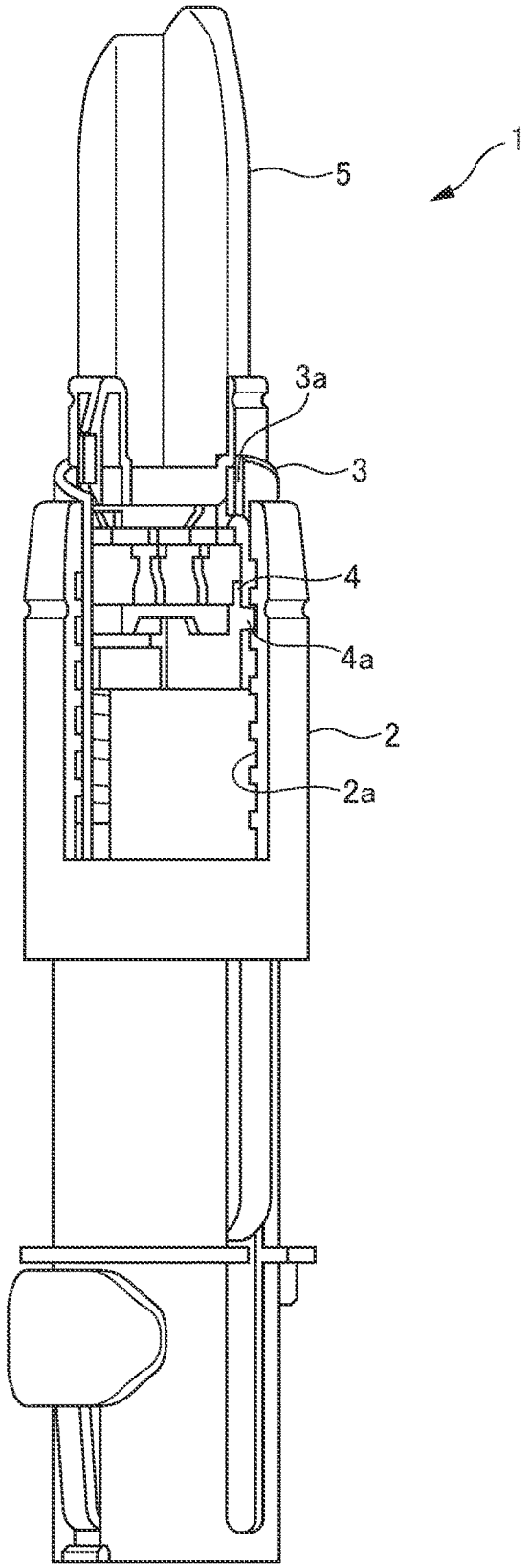
FIG. 1 is a partial cutaway view of a feeding container (first embodiment).

As shown in FIG. 1, in a feeding container (1), an inner cylinder (3) provided with a through groove (3*a*) extending in an axial direction is disposed inside an outer cylinder (2) having a spiral groove (2*a*) on an inner wall surface thereof, an inner plate (4) having a protrusion (4*a*) on a side surface thereof is disposed inside the inner cylinder, and the protrusion (4*a*) of the inner plate passes through the through groove of the inner cylinder to come into engagement with the spiral groove (2*a*) of the outer cylinder.

The feeding container can be used as a feeding container mainly for a stick-shaped cosmetic product such as a lipstick. In this case, the feeding container can employ a method for causing the inner plate to directly hold a lower end portion of a stick-shaped cosmetic product (5) or connecting the inner plate to a holding member that holds the lower end portion of the stick-shaped cosmetic product. The embodiments used herein illustrate an example in which the holding member for holding the lower end portion of the stick-shaped cosmetic product is connected and fixed to the inner plate.

The protrusion (4*a*) of the inner plate is engaged with the spiral groove (2*a*). For this reason, when the outer cylinder (2) moves vertically in the axial direction, the protrusion moves along the through groove (3*a*) of the inner cylinder, moving the inner plate vertically. Furthermore, the spiral groove rotates when the outer cylinder turns about an axis. Since the direction of movement of the protrusion (4*a*) of the inner plate is limited to the vertical direction by the through groove (3*a*) of the inner cylinder, the inner plate moves vertically in accordance with movement of the spiral groove at a position where the protrusion comes into abutment therewith.

Although the number of protrusions provided on the inner plate is not particularly limited, it is preferred that a plurality of the protrusions be placed at equal intervals on a circumference of the inner plate so that the movement of the outer cylinder can stably be transmitted to the inner plate. In the embodiments shown in FIGS. 4 and 5, two protrusions (4*a*, 4*b*) are provided on the inner plate.

In this manner, the inner plate is capable of moving vertically in response to either the vertical movement of the outer cylinder in the axial direction or the rotary movement of the outer cylinder around the axis. Here, in the vertical movement of the outer cylinder in the axial direction, the distance by which the outer cylinder moves and the distance by which the inner plate moves are equal. However, in the rotary movement of the outer cylinder around the axis, the distance by which the inner plate moves is smaller than the distance by which the outer cylinder rotates. Accordingly, the vertical movement of the outer cylinder in the axial direction is suitable for use in an operation for quickly feeding out or storing the stick-shaped cosmetic product, while the rotary movement of the outer cylinder around the axis is suitable for use in an operation for finely adjusting the length of the stick-shaped cosmetic product.

Figure 2:
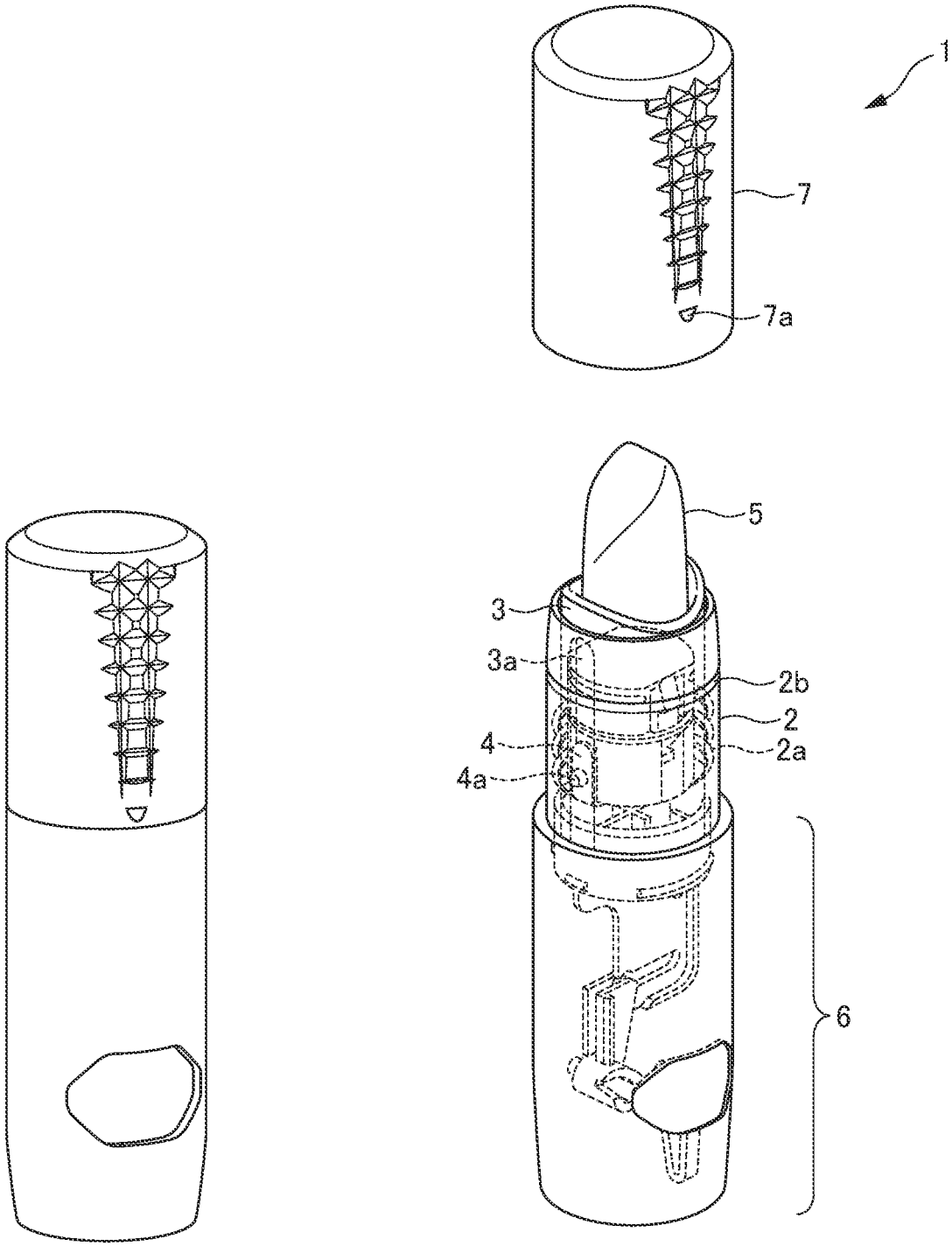
FIG. 2 is an external view (partial perspective view) of the feeding container (first embodiment) ((a) shows a state in which a cap is attached, and (b) shows a state in which the cap is removed).

The vertical movement of the inner plate is regulated by a control mechanism portion connected to the outer cylinder (FIG. 2). The control mechanism portion (6) includes a function for reliably moving the outer cylinder (2) vertically between an upper end point and a lower end point. The outer cylinder can be regulated to reciprocate by a predetermined distance, so that, when the cap (7) is removed and the outer cylinder is caused to slide upward in order to start a makeup application, the stick-shaped cosmetic product can be fed out promptly, and when the outer cylinder is caused to slide downward after the makeup application, the stick-shaped cosmetic product can be stored back into the container and the cap can be attached.

For example, as shown in FIG. 2, by providing a boss (7*a*) protruding to the inside of the cap, and by providing an outer circumference of the outer cylinder with a fitting groove (2*b*) fitted with the boss, the cap rises when being lifted up to remove the cap, in response to which the outer cylinder moves upward and the inner plate rises. Once the outer cylinder reaches the upper end point, the outer cylinder stops moving, and consequently the cap separates from the outer cylinder. The inner plate stops at a predetermined position together with the outer cylinder, and a makeup application can be started with the stick-shaped cosmetic product fed out.

Alternatively, even in a case where a magnet is embedded in the cap and metal such as iron is attached to the outer cylinder, the outer cylinder can be raised to the predetermined position when removing the cap, thereby achieving the same effects.

Figure 3:
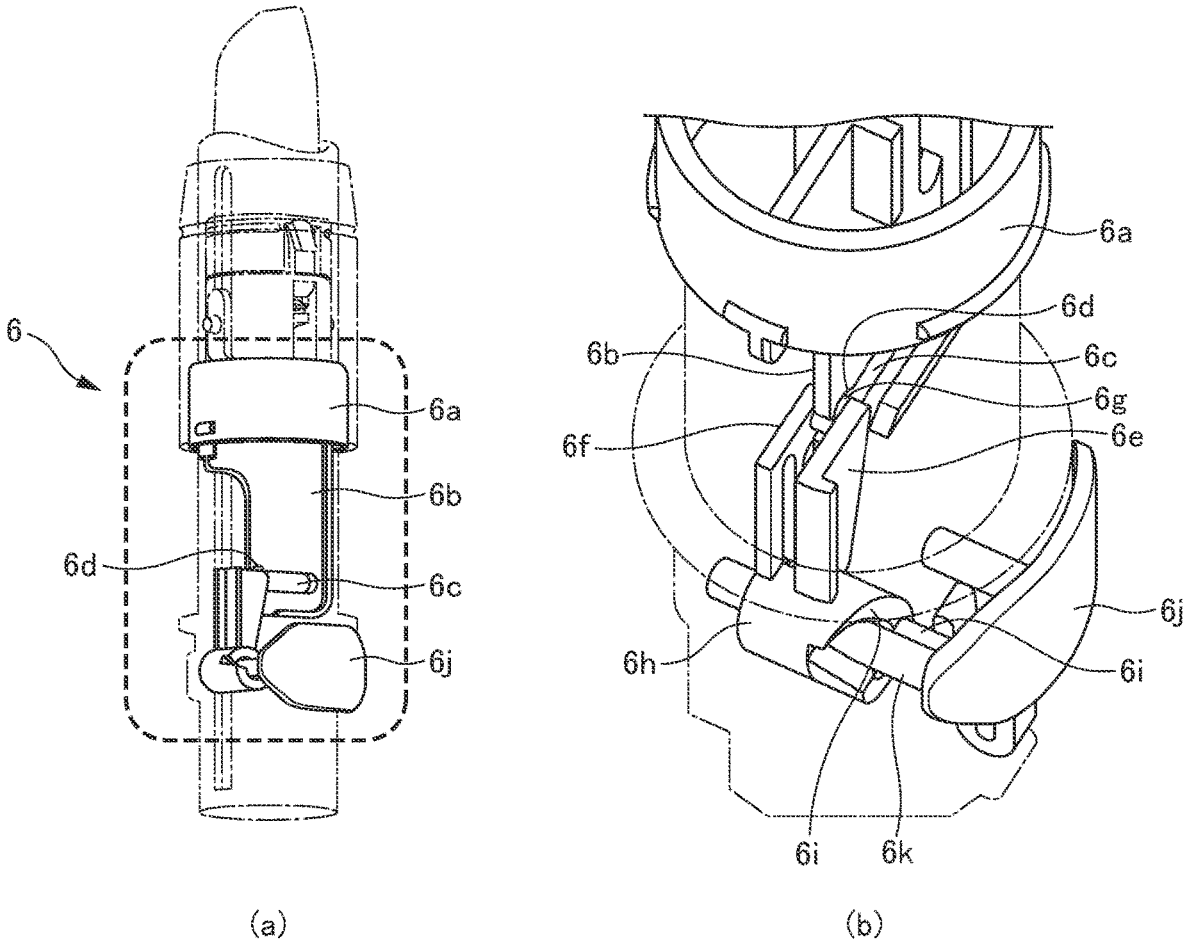
FIG. 3 is a perspective view of the feeding container (first embodiment) ((b) is an enlarged view of a part surrounded by a broken line in (a), viewed from a different angle)

The control mechanism portion (6) can adopt a structure shown in, for example, FIG. 3. In the control mechanism portion shown in FIG. 3, a connecting plate (6*b*) hangs down from a lower end of a connecting member (6*a*) connected to a lower end portion of the outer cylinder, and a through hole (6*c*) extending in a substantially horizontal direction is provided at a lower end portion of the connecting plate. A support pin (6*g*) provided between two support plates (6*e*, 6*f*) passes through the through hole, and, at an upper surface end portion of the through hole, a recess (6*d*) is provided in a position where the recess can be fitted with the support pin (6*g*) when the support plates are vertical.

The two support plates (6*e*, 6*f*) are connected to a rotating cylinder (6*h*), and a rotation shaft (6*k*) extending from a push button (6*j*) passes through the rotating cylinder. Therefore, the support plates can rotate about the rotation shaft (6*k*).

FIG. 3 shows a state in which the outer cylinder have reached the upper end point. In this state, the support plates (6*e*, 6*f*) stand vertically upright, so even when a force is applied to the connecting member (6*a*) from above to below, the support pin (6*g*) becomes fitted with the recess (6*d*), preventing the support plates (6*e*, 6*f*) from rotating.

Thus, the control mechanism portion can be provided with a lock mechanism for preventing the support plates from rotating improperly even when a force is applied from above to the outer cylinder that has reached the upper end point. This can prevent a situation in which the stick-shaped cosmetic product returns to the container by mistake during a makeup application.

Since it is important for the lock mechanism to inhibit the outer cylinder from moving vertically at the upper end point, the lock mechanism does not need a function for inhibiting a movement at the lower end point. However, for a container with a configuration in which the outer cylinder is exposed even after the cap is attached upon completion of a makeup application, the lock mechanism for inhibiting the outer cylinder from moving at the lower end point is preferably provided in order to avoid the risk where the outer cylinder slides by mistake when the container is carried. The lock mechanism can be provided in order to prevent the outer cylinder from moving vertically at the upper end point and/or the lower end point, depending on the shape of the container.

The push button (6*j*) is provided with a push-in rib (6*l*) along the rotation shaft (6*k*), and a tip of the push-in rib is in abutment with an inclined portion (6*i*) provided on an outer wall surface of the rotating cylinder and inclined in a circumferential direction. By pressing the push button, the rotating cylinder (6*h*) is rotated by a force of the push-in rib received by the inclined portion, thereby rotating the support plates (6*e*, 6*f*). The support pin (6*g*) then drops while moving along the through hole (6*c*), and consequently the connecting plate (6*b*) drops, whereby the outer cylinder (2) is drawn downward together with the connecting member (6*a*).

Accordingly, the control mechanism portion can include an unlock mechanism for releasing the restraint of the vertical movement of the outer cylinder, and a return mechanism for pulling the outer cylinder downward.

Figure 5:
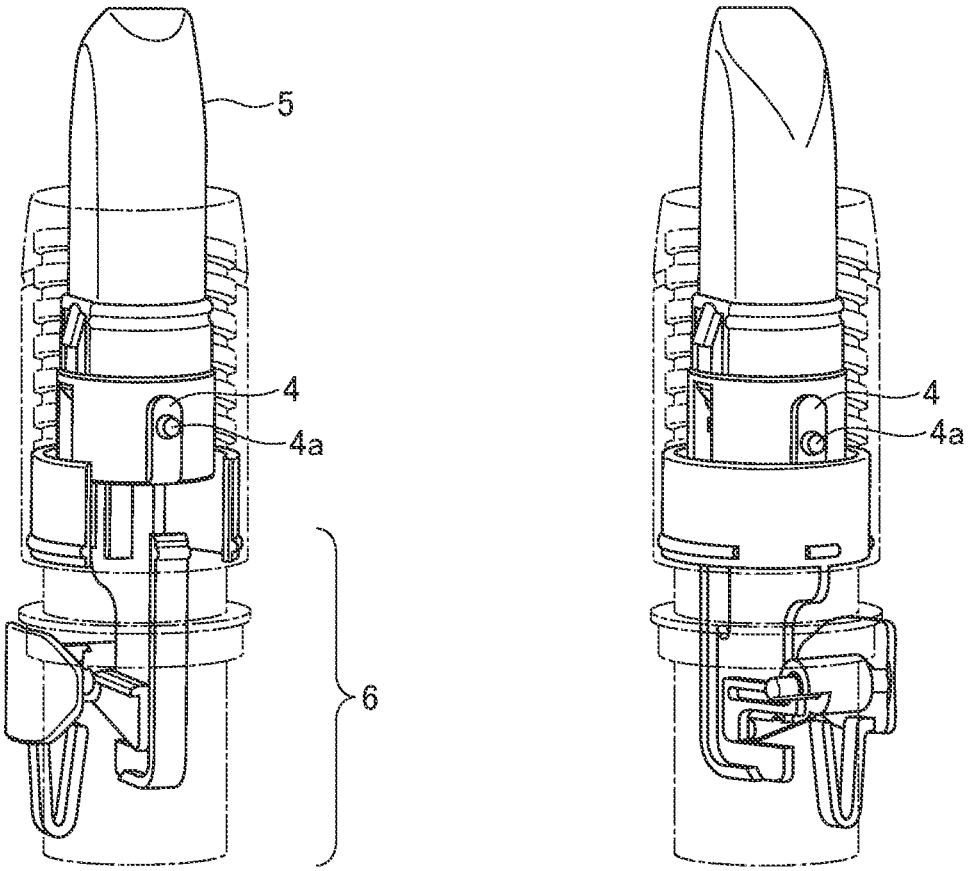
FIG. 5 is a perspective view of the feeding container (first embodiment), showing a state in which the cosmetic product is stored ((b) is a diagram in which (a) is viewed from a different angle).

Upon completion of a makeup application, the support plates are rotated by pressing the push button, pulling the stick-shaped cosmetic product back to the position where the cap can be attached, and consequently the cap can be attached (FIG. 5).

Figure 4:
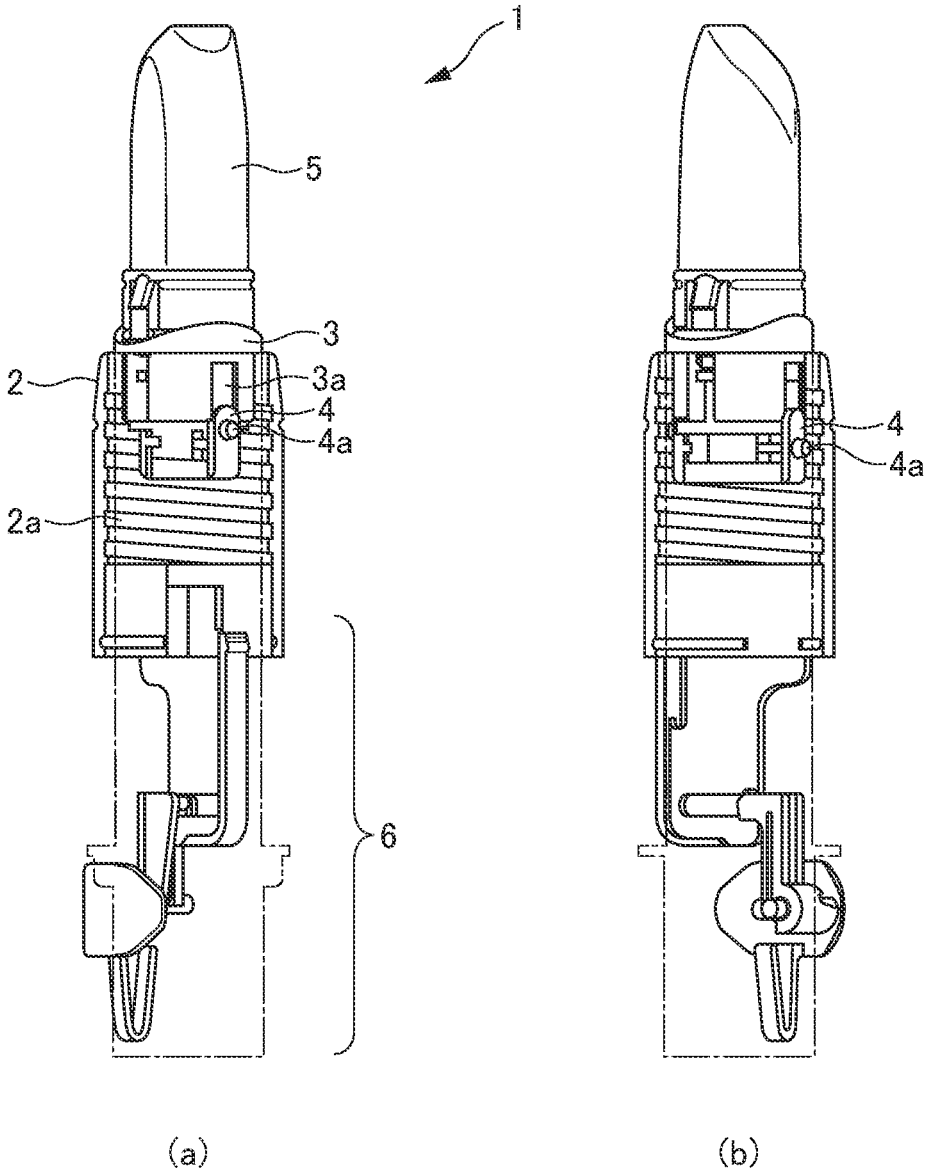
FIG. 4 is a perspective view of the feeding container (first embodiment), showing a state in which a cosmetic product is fed out ((b) is a diagram in which (a) is viewed from a different angle).

Again, when starting a makeup application, by removing the cap and moving the outer cylinder upward, the cosmetic product can be fed out with a single touch, to the position where the makeup application is enabled (FIG. 4). Thus, a user does not need to repeatedly adjust the length of the stick-shaped cosmetic product to feed out every time when applying makeup, allowing the user to perform a smooth makeup application.

Figure 6:
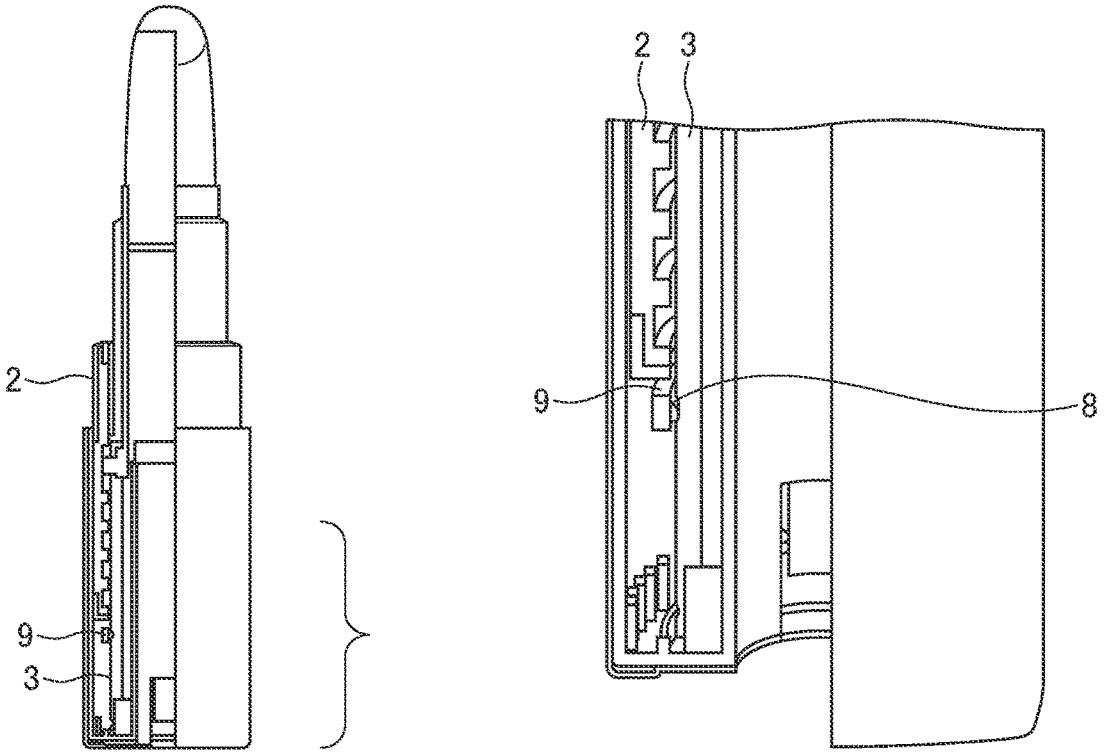
FIG. 6 is a partial cutaway view of a feeding container (second embodiment) ((a) shows a state in which a cosmetic product is fed out, and (b) shows a state in which the cosmetic product is stored).
Figure 6:
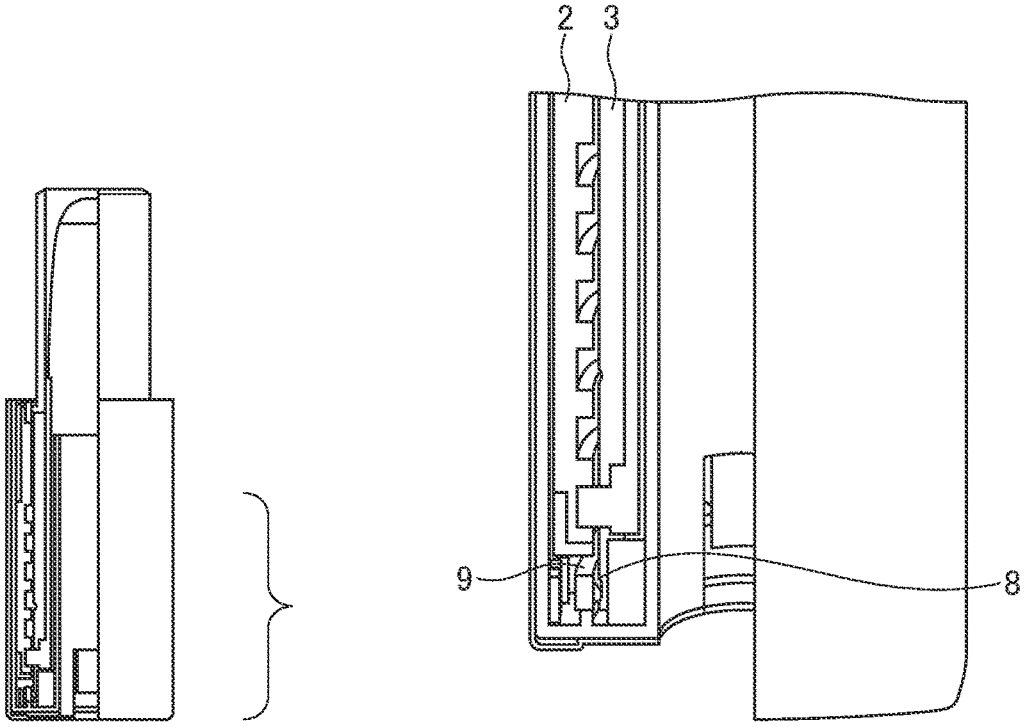

In addition, as shown in FIG. 6, by providing a recess (8) at a predetermined height on an outer wall surface of the inner cylinder (3), and a spring protrusion (9) at a lower end of the outer cylinder (2), the spring protrusion (9) moving vertically along with the outer cylinder and coming into engagement with the recess, the outer cylinder can be inhibited from moving at the end point of the vertical movement thereof (the upper end point and/or the lower end point), thereby preventing the outer cylinder from moving vertically by mistake. The recess and the spring protrusion described above function as the control mechanism portion for regulating the range of the vertical movement of the outer cylinder in the axial direction and function as the lock mechanism for inhibiting the vertical movement of the outer cylinder. The vertical movement of the outer cylinder (2) can be obtained by grasping the outer cylinder with fingers.

Although the stick-shaped cosmetic product can be fed out by a predetermined length or stored by moving the outer cylinder vertically in the axial direction, since the stick-shaped cosmetic product gradually becomes short with the use thereof, the length of the stick-shaped cosmetic product to be fed out needs to be adjusted. Moreover, in some cases, the length of the cosmetic product is adjusted during a makeup application.

In such a case, the length of the stick-shaped cosmetic product can be finely adjusted by rotating the outer cylinder about the axis and moving the inner plate vertically little by little. Even after the fine adjustment of the stick-shaped cosmetic product, pressing the push button and pulling the outer cylinder downward can allow the cap to be attached.

REFERENCE SIGNS LIST

1 Feeding container
2 Outer cylinder
2*a* Spiral groove
2*b* *Fitting groove*
3 Inner cylinder
3*a* Through groove
4 Inner plate
4*a* Protrusion
4*b* Protrusion
5 Stick-shaped cosmetic product
6 Control mechanism portion
6*a* Connecting member
6*b* Connecting plate
6*c* Through hole
6*d* Recess
6*e* Support plate
6*f* Support plate
6*g* Support pin
6*h* Rotating cylinder
6*i* *Inclined portion*
6*j* Push button
6*k* Rotation shaft
6*l* Push-in rib
7 Cap
7*a* *Boss*
8 Recess
9 Spring protrusion

The invention claimed is:

1. A feeding container, in which an inner cylinder provided with a through groove extending in an axial direction is disposed inside an outer cylinder having a spiral groove on an inner wall surface thereof, an inner plate having a protrusion on a side surface thereof is disposed inside the inner cylinder, and the protrusion of the inner plate passes through the through groove of the inner cylinder to come into engagement with the spiral groove of the outer cylinder, whereby the inner plate moves vertically in response to either a vertical movement of the outer cylinder in the axial direction or a rotary movement of the outer cylinder around an axis.

2. The feeding container according to claim 1, comprising a control mechanism portion that is connected to the outer cylinder and regulates a range of the vertical movement of the outer cylinder in the axial direction.

3. The feeding container according to claim 2, wherein the control mechanism portion includes a lock mechanism for suppressing the vertical movement of the outer cylinder.

* * * * *